US009009987B2

(12) United States Patent
Lee et al.

(10) Patent No.: US 9,009,987 B2
(45) Date of Patent: Apr. 21, 2015

(54) CLOTHING DRYER AND CONTROL METHOD THEREOF

(71) Applicant: Samsung Electronics Co., Ltd., Suwon (KR)

(72) Inventors: Hyung Woo Lee, Suwon (KR); Hee Beom Park, Anyang (KR); Ja Young Kim, Seoul (KR); Sang Oh Yoo, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 227 days.

(21) Appl. No.: 13/692,430

(22) Filed: Dec. 3, 2012

(65) Prior Publication Data

US 2013/0145642 A1 Jun. 13, 2013

(30) Foreign Application Priority Data

Dec. 8, 2011 (KR) ..... 10-2011-0130801

(51) Int. Cl.

| | |
|---|---|
| ***F26B 25/06*** | (2006.01) |
| ***F26B 21/06*** | (2006.01) |
| ***F26B 3/00*** | (2006.01) |
| ***F26B 5/00*** | (2006.01) |
| ***D06F 58/28*** | (2006.01) |

(52) U.S. Cl.

CPC ..... *F26B 21/06* (2013.01); *F26B 25/06* (2013.01); *F26B 3/00* (2013.01); *F26B 5/00* (2013.01); *D06F 58/28* (2013.01); *D06F 2058/2809* (2013.01); *D06F 2058/288* (2013.01); *D06F 2058/289* (2013.01); *D06F 2058/2896* (2013.01)

(58) Field of Classification Search

USPC ..... 34/380, 381, 413, 443, 601, 606, 610; 374/45, 50; 706/46, 52; 68/5 R, 12.02, 68/19, 20; 700/1, 14

See application file for complete search history.

(56) References Cited

U.S. PATENT DOCUMENTS

| | | | | |
|---|---|---|---|---|
| 3,309,783 | A * | 3/1967 | Worst | 34/553 |
| 5,396,413 | A * | 3/1995 | Kaneko et al. | 700/1 |
| 5,555,645 | A * | 9/1996 | Joslin | 34/499 |
| 5,651,194 | A * | 7/1997 | Hayashi | 34/550 |

(Continued)

FOREIGN PATENT DOCUMENTS

| | | |
|---|---|---|
| EP | 1103648 A2 | 5/2001 |
| EP | 1852540 A1 | 7/2007 |

(Continued)

OTHER PUBLICATIONS

Extended European Search Report issued Apr. 11, 2013 in corresponding European Patent Application No. 12196098.3.

*Primary Examiner* — Steve M Gravini
(74) *Attorney, Agent, or Firm* — Staas & Halsey LLP

(57) ABSTRACT

A clothing dryer capable of effectively drying a small amount of substance, and a control method thereof by changing an algorithm of a sensor-dry course, which is configured to control an operation rate, a degree of drying or a temperature of drying, to be adapted to the small load of substance in a case where the substance to be dried has a small load when compared to the entire volume of the clothing dryer, so that the drying efficiency is enhanced regardless of the load of the substance, and a separate option button is provided for a sensor-dry course, so that a small load of substance is dried adaptively to the material characteristic of the substance for a respective dry course, thereby enhancing the drying efficiency.

14 Claims, 11 Drawing Sheets

(56) References Cited

U.S. PATENT DOCUMENTS

| | | | | |
|---|---|---|---|---|
| 6,125,490 | A | 10/2000 | Riechman et al. | |
| 6,519,871 | B2 * | 2/2003 | Gardner et al. | 34/497 |
| 7,325,330 | B2 * | 2/2008 | Kim et al. | 34/407 |
| 7,536,807 | B2 * | 5/2009 | Baier | 34/601 |
| 7,921,578 | B2 * | 4/2011 | McAllister et al. | 34/597 |
| 7,992,321 | B2 * | 8/2011 | Ricklefs et al. | 34/595 |
| 7,997,006 | B2 * | 8/2011 | Son et al. | 34/381 |
| 8,104,191 | B2 * | 1/2012 | Ricklefs et al. | 34/474 |
| 2014/0257588 | A1 * | 9/2014 | Matesa, Jr. | 700/297 |

FOREIGN PATENT DOCUMENTS

| | | |
|---|---|---|
| JP | 63-127793 | 5/1988 |
| JP | 2002-336593 | 11/2002 |
| JP | 2004-267334 | 9/2004 |
| WO | WO 2006/098571 A1 | 9/2006 |
| WO | WO 2007/119974 A2 | 10/2007 |

* cited by examiner

CLOTHING DRYER AND CONTROL METHOD THEREOF

CROSS-REFERENCE TO RELATED APPLICATIONS

This application claims the benefit of Korean Patent Application No. 10-2011-0130801, filed on Dec. 8, 2011 in the Korean Intellectual Property Office, the disclosure of which is incorporated herein by reference.

BACKGROUND

1. Field

Embodiments of the present disclosure relate to a clothing dryer for drying a substance such as clothes, and more particularly, to a clothing dryer capable of effectively drying a small amount of substance, and a control method thereof.

2. Description of the Related Art

A clothing dryer is an apparatus designed to dry clothes to be dried (hereinafter, referred to as a substance to be dried) while rotating a dry tub (drum) accommodating the substance to be dried and supplying air heated by a hot air heater. The clothing dryer as such is divided into an exhaust-type dryer to exhaust a high-temperature, humid air passing through the dry tub, to an outside the dryer, and a condenser-type dryer to remove humidity from a high-temperature, humid air and to recycle the air having the humidity removed therefrom to an inside of the dry tub.

The clothing dryer is provided with a dry course including a sensor-dry course to automatically determine a degree of drying a substance and to sense a target degree for termination of drying, and a manual dry course to have a user randomly set the time and the temperature to dry a substance.

In general, the sensor-dry course has the designated temperature and the time for the material characteristic of each substance to be dried, thereby inducing a user to select a course suitable for the material. In this case, if a small load of substance having a less amount thereof or a small size thereof is input and dried in the dryer, an algorithm for each dry course (a normal dry course, a towel dry course, a perm dry course, or a delicate dry course) designed based on a conventional standard capacity, a sensing value of the degree of drying, or a characteristic value for temperature increase and control may be changed. In addition, if a small load of substance has an amount less than the entire volume of the clothing dryer (in detail, the volume of the dry tub), the determination on the degree of drying and the capability to control the temperature are degraded at the sensor-dry course, so that drying is not effectively performed and the substance remains damp at the termination of the dry course.

In a case where a manual dry course is conducted to prevent the drawback as such, an inconvenience of a user in manually operating the dryer and an error in drying, such as an excessive drying or an incomplete drying, may occur.

SUMMARY

Therefore, it is an aspect of the present disclosure to provide a clothing dryer capable of enhancing the drying efficiency on a small amount of substance at a sensor-dry course, and a control method thereof.

Additional aspects of the disclosure will be set forth in part in the description which follows and, in part, will be apparent from the description, or may be learned by practice of the disclosure.

In accordance with one aspect of the present disclosure, a clothing dryer includes a dry tub, a first selecting unit, a second selecting unit, and a control unit. The dry tub may be configured to accommodate a substance to be dried. The first selecting unit may be configured to select one of a plurality of dry courses that are set. The second selecting unit may be configured to select an amount of the substance. The control unit may be configured to select a course algorithm for the selected dry course, and change the course algorithm according to the selected amount of the substance.

The plurality of dry courses each may represent a dry course set according to a type of the substance.

The second selecting unit may be a small load button selected by a user as the user determines whether the amount of the substance corresponds to a small load.

The small load button may be a manipulation button selected by a user after the user checks sensing information about the amount of substance.

The control unit may determine that the amount of the substance corresponds to a small load based on the selecting of the small load button, and change the course algorithm to be adapted to the small load.

The selected course algorithm may conduct a drying cycle with a drying temperature, a drying time, and an operation rate that are set to be adapted to the type of the substance.

The selected course algorithm may have a drying temperature, a drying time, and an operation rate set based on a normal load of a standard capacity.

The changed course algorithm may conduct a drying cycle while changing at least one of the drying temperature, the drying time, and the operation rate that are set to be adapted to the type of the substance.

The control unit may conduct the changed course algorithm by controlling on/off of an operation rate of the dry tub to be adapted to the small load.

The clothing dryer may further include a dryness sensor configured to measure a degree of dryness of the substance. The control unit may conduct the changed course algorithm by setting a drying time to be adapted to the small load according to a variation of a dryness sensing value measured through the dryness sensor.

The control unit may conduct the changed course algorithm by reducing a heater control temperature configured to adjust a temperature of inside of the dry tub to be adapted to the small load.

In accordance with another aspect of the present disclosure, a method of controlling a clothing dryer to dry a substance accommodated in a dry tub is as follows. At least dry course may be selected among a plurality of dry courses that are set according to a type of the substance. A course algorithm may be selected according to the selected dry course. Load information may be selected according to an amount of the substance. The selected course algorithm may be changed according to the selected load information.

The selecting of the load information may determine whether a small load button configured to select whether the amount of the substance corresponds to a small load is selected.

The method may further include measuring a degree of dryness of the substance. The changed course algorithm may set a drying time to be adapted to the small load according to a variation of a sensing value of the measured degree of dryness.

The changed course algorithm may reduce a heater control temperature configured to adjust a temperature of inside of the dry tub to be adapted to the small load.

As described above, in a case where the substance to be dried has a small load when compared to the entire volume of the clothing dryer, an algorithm of a sensor-dry course, which is configured to control an operation rate, a degree of drying or a temperature of drying, is changed to be adapted to the small load of substance, thereby enhancing the drying efficiency regardless of the load of the substance.

In addition, a separate option button is provided for a sensor-dry course, so that a small load of substance is dried adapted to the material characteristic of the substance for a respective dry course, thereby enhancing the drying efficiency.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
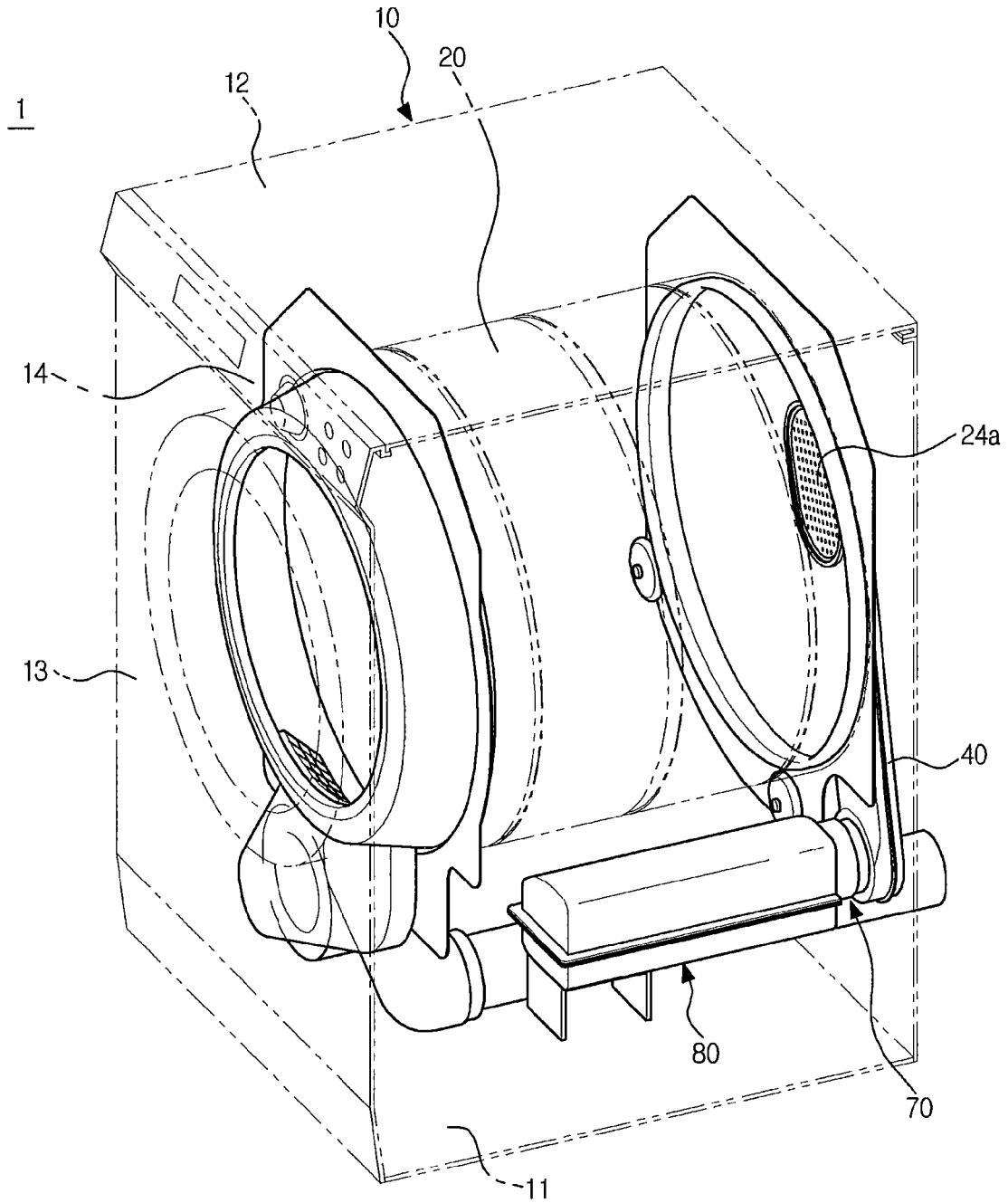
FIG. 1 is a perspective view illustrating a clothing dryer in accordance with one embodiment of the present disclosure.

Reference will now be made in detail to the embodiments of the present disclosure, examples of which are illustrated in the accompanying drawings, wherein like reference numerals refer to like elements throughout.

Figure 2:
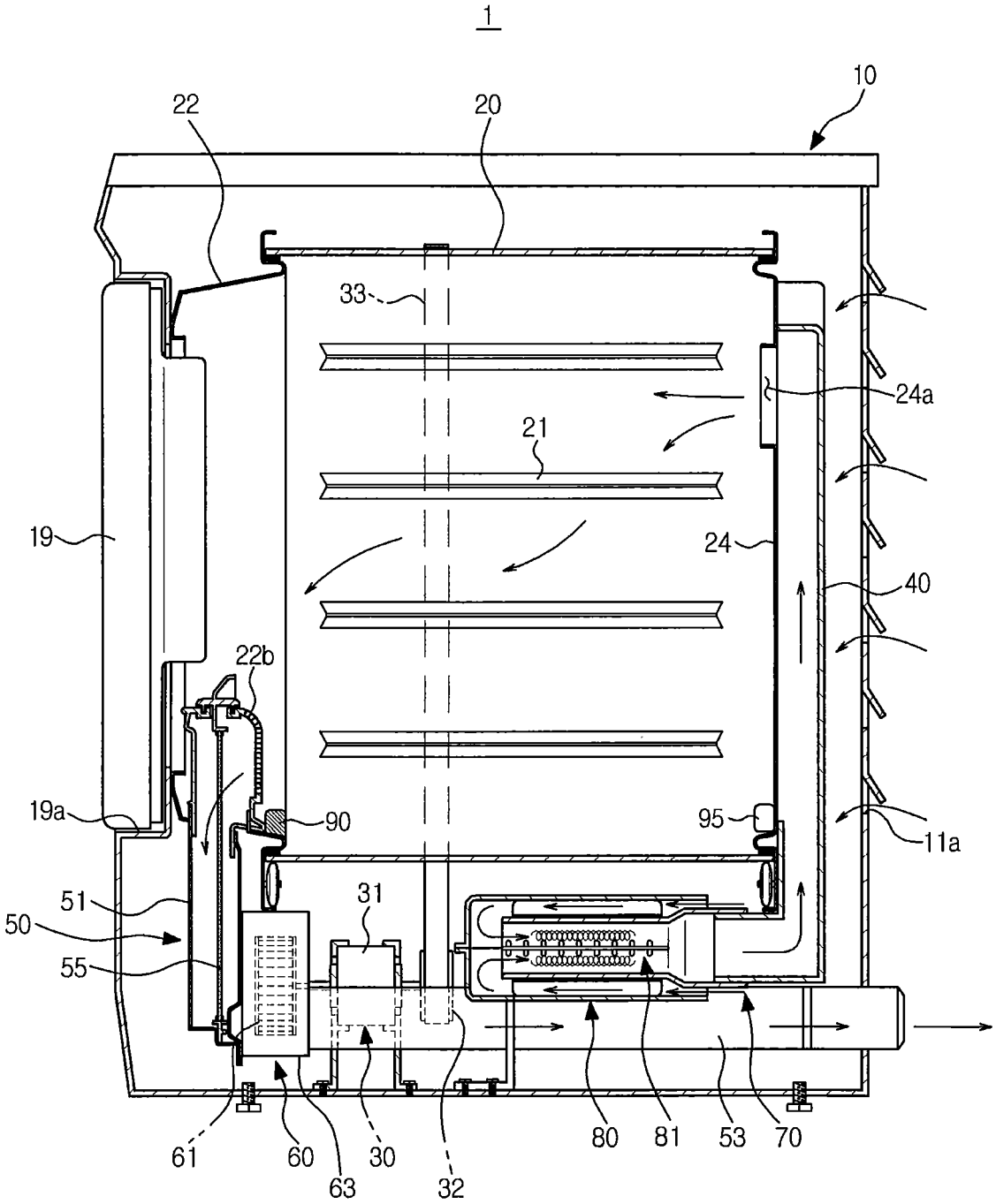
FIG. 2 is a cross-sectional view illustrating the clothing dryer in accordance with the embodiment of the present disclosure.

FIG. 1 is a perspective view illustrating a clothing dryer in accordance with one embodiment of the present disclosure. FIG. 2 is a cross-sectional view illustrating the clothing dryer in accordance with the embodiment of the present disclosure.

Referring to FIGS. 1 and 2, a clothing dryer 1 includes a body 10 provided in an approximately rectangular shape, a dry tub 20 having a space in which a substance is to be dried, a driving apparatus 30 to rotate the dry tub 20 and a hot air duct 70 to supply the dry tub 20 with hot air.

The body 10 includes a cabinet 11, a top cover 12 to cover an upper portion of the cabinet 11, a front surface panel 13 disposed at a front surface of the cabinet 11, and a control panel 14 on which various types of buttons for the controlling of the clothing dryer 1 and a display are disposed.

The dry tub 20 is provided in a cylindrical shape having an open front surface and an open rear surface, and provided with a plurality of lifters 21 protruding from an inner surface thereof in a shape of a crest. In addition, a front side support plate 22 and a rear side support plate 24 are installed at an inner side of the body 10 while being fixed to a front surface portion and to a rear surface portion of the inside the body 10 to rotatably support the front surface and the rear surface of the dry tub 20, respectively, while closing the front surface and the rear surface of the dry tub 20.

An inlet 19*a* is formed at each of the front surface of the body 10 and the front side support plate 22 to input or withdraw the substance into/from the dry tub 20. A door 19 is installed at the front surface of the body 10 to open and close the inlet 19*a*.

The driving apparatus 30 includes a driving motor 31 installed at a lower portion of the inside the cabinet 10, and a pulley 32 and a rotary belt 33 that transmit a driving force of the driving motor 31 to the dry tub 20. The rotary belt 33 is installed to be wound on an outer surface of the dry tub 20 and the pulley 32 coupled to a shaft of the driving motor 31.

The hot air duct 70 includes a heating unit 80 to heat the air introduced thereinto, and a hot air supply unit 40 to connect the heating unit 80 to the dry tub 20.

The hot air supply unit 40 forms an air passage by connecting a dry tub intake port 24*a* formed at an upper portion of the rear support plate 24 to the heating unit 80. In addition, the hot air supply unit 40 serves to guide the air drawn and heated to the dry tub 20.

The heating unit 80 is installed at a lower portion of the dry tub 20 to guide the introduction of outside air and heat the introduced air. The heating unit 80 is provided therein with a heater 81 to emit heat. The heater 81 installed at the heating unit 80 is implemented using a coil heater, and is provided in at least one thereof. The at least one heating unit 80 may have a different power capacity or the same power capacity. For example, when the total power capacity (100%) is set to be about 5.3 kW, one heater may have a large power capacity of about 3.7 kW (70%) and the other heater may have a smaller power capacity of about 1.6 kW (30%) in forming the heating unit 80. In this case, the division of the capacity of the heater is not limited to 70%:30%. When dividing the capacity of the heater at the optimum requirements, the capacity of the heater may be divided in a variety of ratios.

In addition, an exhaust duct 50 is connected to a lower portion of the front side of the dry tub 20, and serves to guide the discharging of the air introduced into the inside the dry tub 20. The exhaust duct 50 includes a front side exhaust duct 51 connecting a exhaust port 22*b* of a lower portion of the front side support plate 22 to an entry of a blower apparatus 60 installed at a lower portion of the dry tub 20, and a rear side exhaust duct 53 installed at a lower side of the cabinet 11 such that an exit of the blower apparatus 60 communicates with the outside of the rear surface 11*a* of the cabinet 11.

A dryness sensor 90 is installed at a lower end portion of the front surface of the dry tub 20 where the exhaust port 22*b* is formed. The dryness sensor 90, while making contact with the substance rotating along with the rotation of the dry tub 20, measures a sensing value of an electrical signal that varies with the amount of the moisture contained in the substance. The dryness sensor 90 may be implemented using a touch sensor having a form of a plate bar.

In addition, a temperature sensor 95 is installed at a lower end portion of the rear surface where the rear side support plate 24 is installed, so as to detect the temperature of the air inside the dry tub 20.

The front side exhaust duct 51 is provided with a filter member 55 installed thereto to filter foreign substance such as dust and lint that may be included in the hot air discharged from the dry tub 20.

The blower apparatus 60 having an entry connected to the front side exhaust duct 51 includes a blower fan 61 installed at a front side of the lower portion of the dry tub 20 for circulation of the air, and a blower case 63 connected to each of the front side exhaust duct 51 and the rear side exhaust duct 53.

Meanwhile, the description of the clothing dryer 1 in accordance with the embodiment of the present disclosure has been made in relation to an exhaust-type dryer as an example. However, the present disclosure may be applied to a condensation-type dryer as well.

Figure 3:
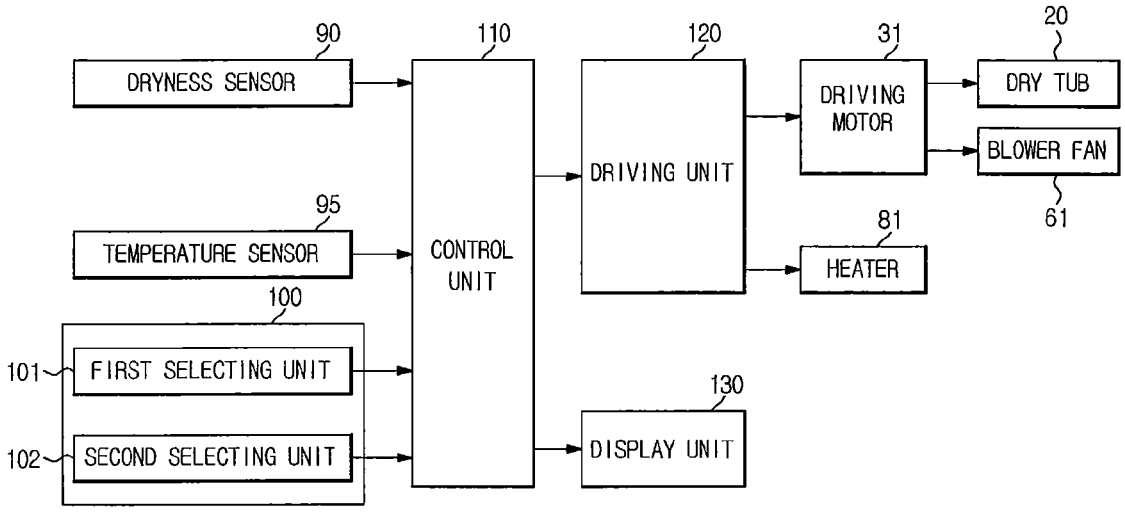
FIG. 3 is a block diagram illustrating a control configuration of the clothing dryer in accordance with the embodiment of the present disclosure.

FIG. 3 is a block diagram illustrating a control configuration of the clothing dryer in accordance with the embodiment of the present disclosure. The clothing dryer includes an input unit 100, a control unit 110, and a display unit 130.

The input unit 100 is configured to input operational information, selected by a user, which involves a dry course including a dry course (for example, a normal-dry course, a towel-dry course, a perm-dry course and a delicate-dry course), the drying time and the operational command.

In addition, the input unit 100 is provided with a first selecting unit 101 for a user to select a dry course to be adapted to the type of the substance, and a second selecting unit 102 to select whether the amount of the substance corresponds to a small load by determining whether the amount of the substance is small.

The second selecting unit 102 represents a small load button separately provided on the control panel 14 to change an algorithm of a sensor-dry course to be adapted to the small load, if the amount of the substance corresponds to a small load.

In addition, the input unit 100 is provided with a jog dial in addition to the buttons described above to select the state of dryness, for example, a half-dried state and a completely-dried state. In addition, the input unit 100 may be further provided with a change button capable of adjusting the operation rate and the drying time of the selected dry course.

In general, the sensor-dry course has an algorithm designed based on a standard capacity. Since a determination sensing on the amount of the substance does not exist, or has a low accuracy in the sensor-dry course, a small load is difficult to be determined. Currently, the load of the substance is determined by use of the dryness sensor 90, in which the load of the substance is determined by use of an electrical signal measured through the dryness sensor 90, so the electrical signal measured through the dryness sensor 90 may be inaccurate depending on the amount, the type, and the moisture content of the substance. Accordingly, due to the inaccurate measurement of the load of the substance, a likeness to have a drying error, such as excessive drying or incomplete drying still exists.

According to the embodiment of the present disclosure, the second selecting unit 102 corresponding to a separate button for a small load is used for a user to make a determination on the amount of the substance before a drying cycle starts, thereby improving the error with drying of a small load.

In addition, the second selecting unit 102 is available for selection in all the dry courses such that an algorithm for a dry course is changed with the temperature and the sensing range according to the cloth material of the substance while using the drying temperature and the drying time set to be adapted to the cloth material of the substance for each dry course (the normal-dry course, a towel-dry course, the perm-dry course, and the delicate-dry course) thereby improving the error with drying such as an excessive drying or an incomplete drying.

The control unit 110 represents a microcomputer to control the overall operation of the clothing dryer according to the operational information input from the input unit 100. The control unit 110 controls the drying cycle while driving a drying section according to the degree of dryness of the substance determined by the dryness sensor 90.

In addition, the control unit 110 primarily determines that the amount of the substance that corresponds to a small load based on the selection of the second selecting unit 102 provided at the input unit 100, and while compensating for the degradation of the determination of the dryness and the performance of the temperature control at the small load, secondarily controls such that the algorithm of the sensor-dry course is changed into an algorithm to control the operation rate, the dryness or the temperature to be adapted to the characteristics of the small load.

The driving unit 120 drives the driving motor 31 related to the operation of the clothing dryer 1 and the heater 81 according to a drive control signal of the control unit 110.

The display unit 130 is provided on the control panel 14, and displays an operation state of the clothing dryer 1 according to a display control signal of the control unit 110 while displaying a manipulation state of the user by recognizing touch information input through a user interface.

Meanwhile, a method of changing an algorithm of a sensor-dry course to be adapted to a small load of substance in the control unit 110 is as follows.

The method of changing an algorithm of a sensor-dry course includes (1) a scheme of controlling an operation rate to be adapted to a small load, (2) a scheme of setting a control temperature of the latter half of a drying operation in consideration of the rise of the internal temperature of the dry tub 20 during the drying of a small load, and (3) a scheme of setting a drying time suitable for the characteristic of a small load through the variation of a dryness sensing value in the beginning of drying.

Hereinafter, (1) the scheme of controlling an operation rate to be adapted to a small load will be described as an example of the method of changing an algorithm of a sensor-dry course.

Prior to the description of the scheme of controlling the operation rate, the state of a substance rotating inside the dry tub 20 according to the amount of the substance will be described with reference to FIGS. 4 and 5.

Figure 4:
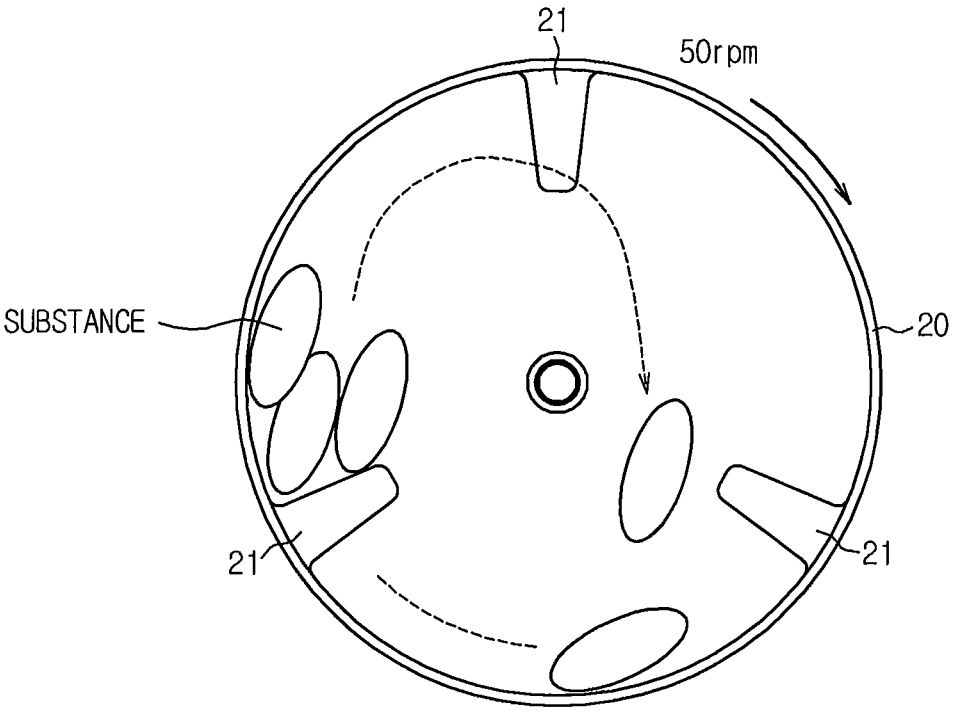
FIG. 4 is a view illustrating a state of a substance inside a dry tub of the clothing dryer in accordance with the embodiment of the present disclosure, during a drying operation for a normal load.

FIG. 4 is a view illustrating a state of a substance inside a dry tub of the clothing dryer in accordance with the embodiment of the present disclosure, in a drying operation for a normal load. FIG. 5 is a view illustrating a state of a substance inside a dry tub of the clothing dryer in accordance with the embodiment of the present disclosure, in a drying operation for a small load.

Referring to FIG. 4, in an operation of drying a substance having a normal load of a standard capacity, the dry tub 20 is supplied with a driving force of the driving motor 31 and is rotated at a speed of about 50 RPM in one direction.

While the dry tub 20 rotates at a speed of about 50 RPM, the substance of a normal load inside the dry tub 20 is smoothly tumbled even at a dryness exceeding a predetermined degree of dryness while being mixed.

Meanwhile, in an operation of drying a substance having a load smaller than the standard capacity, if the dry tub 20 is rotated at about 50 RPM in one direction described above, the substance of a small load inside the dry tub 20 becomes lighter, and as the dryness exceeds a predetermined degree of dryness, is put under a situation where a force of gravity is greater than a centrifugal force.

Figure 5:
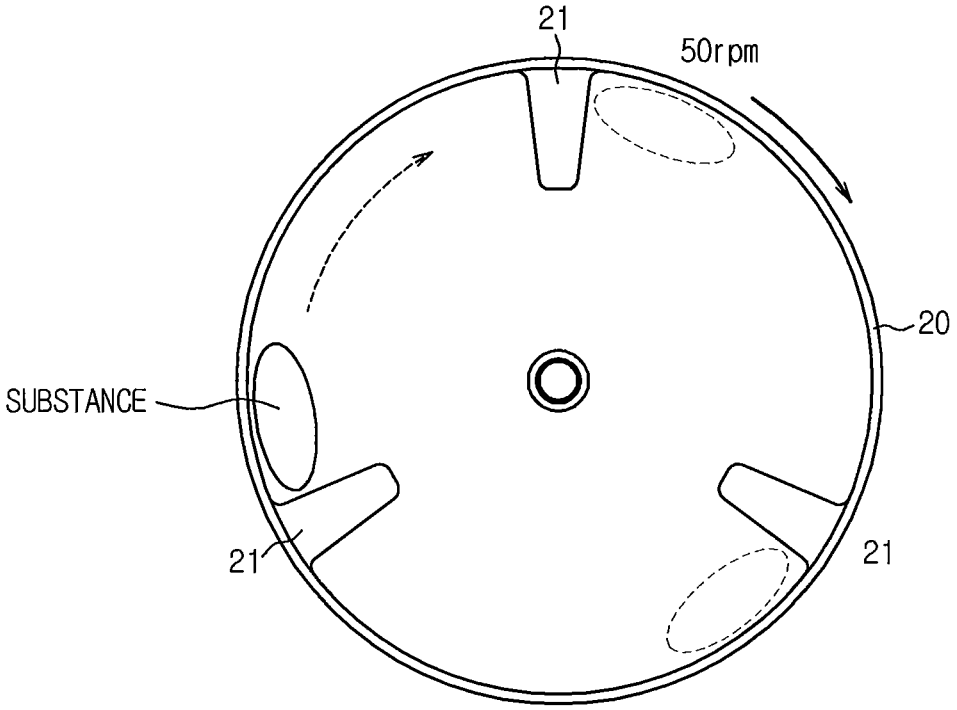
FIG. 5 is a view illustrating a state of a substance inside a dry tub of the clothing dryer in accordance with the embodiment of the present disclosure, during a drying operation for a small load.

Accordingly, the substance of a small load is rotated while being attached to an inner wall of the dry tub 20 as shown in FIG. 5, when the dry tub 20 is rotated at a speed of about 50 RPM, so that the substance attached to the inner wall of the dry tub 20 fails to make contact with the heated air (hot air), causing an error with drying in which the substance is not dried until the termination of the drying operation.

According to the embodiment of the present disclosure, in order to remove the dry error that may occur in a small load of substance, the scheme of controlling the operation rate such that the substance of a small load is dried while being evenly mixed without being rotated along the dry tub 20 will be described with reference to FIGS. 6 and 7.

Figure 6:
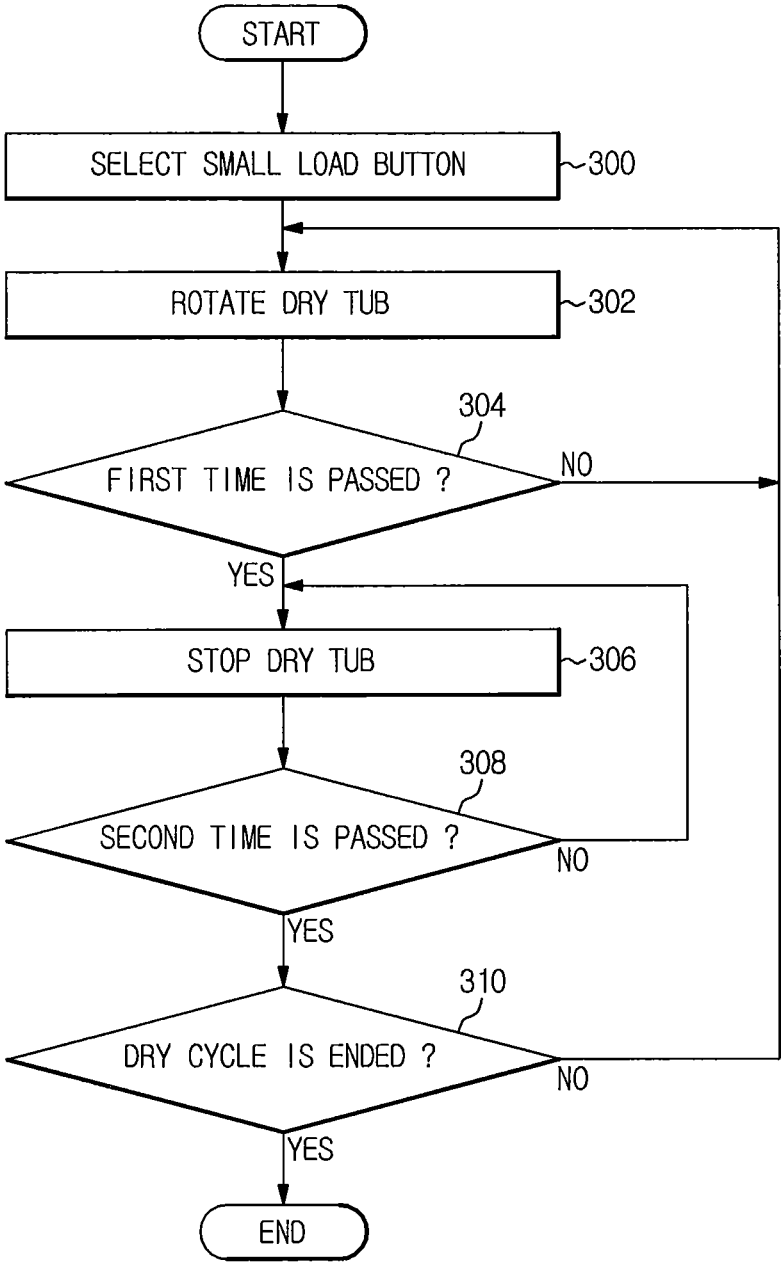
FIG. 6 is a flowchart illustrating an algorithm for controlling an operation rate of a drying operation for a small load, in accordance with the embodiment of the present disclosure.
Figure 7A:
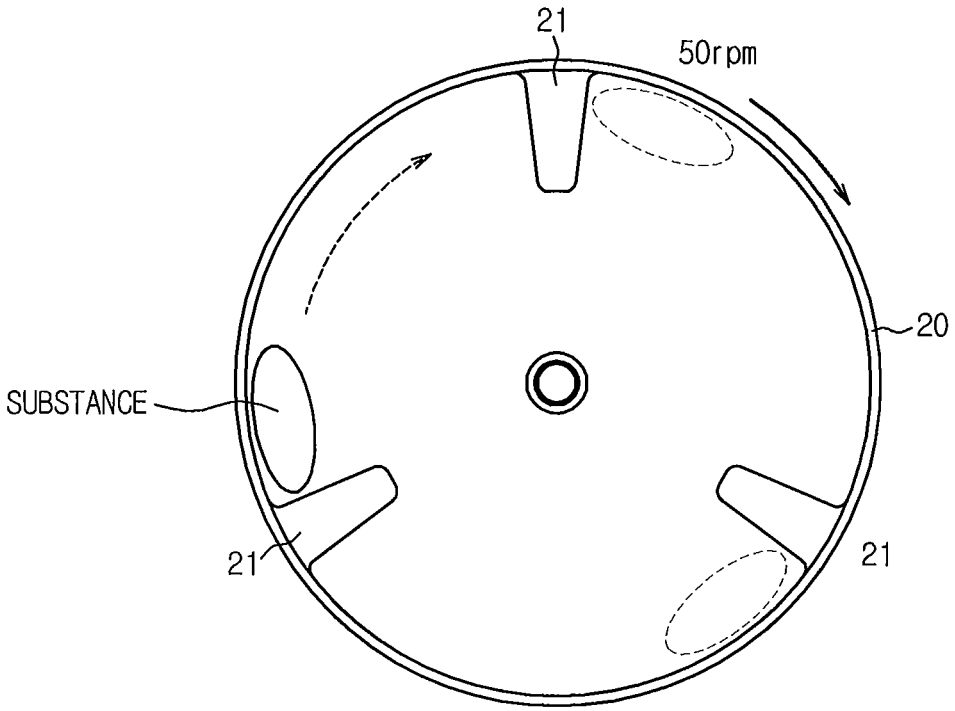
FIGS. 7A to 7C are views illustrating a state of a substance inside a dry tub of the clothing dryer having an operation rate controlled in accordance with the embodiment of the present disclosure, during a drying operation for a small load.
Figure 7B:
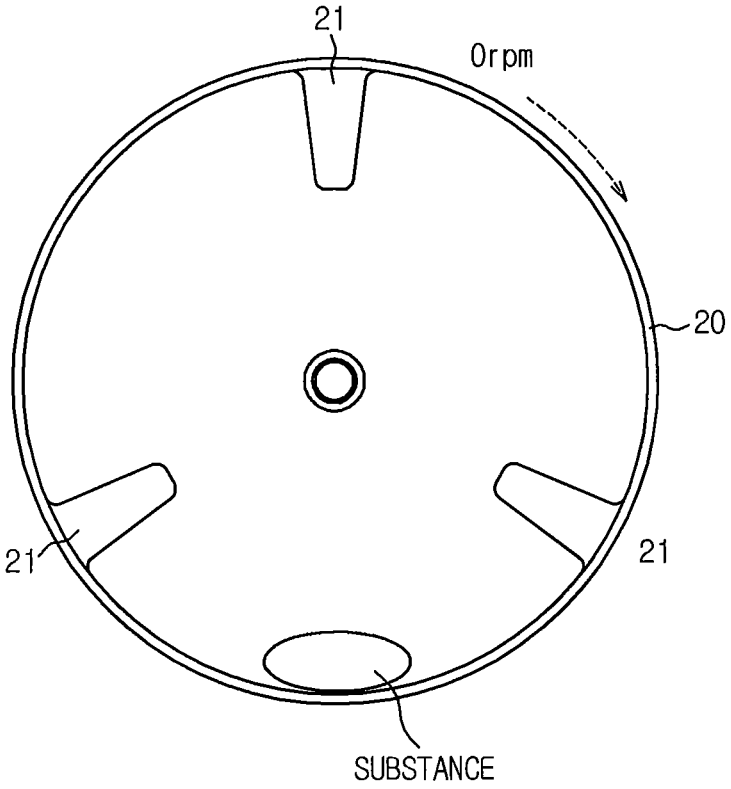
Figure 7C:
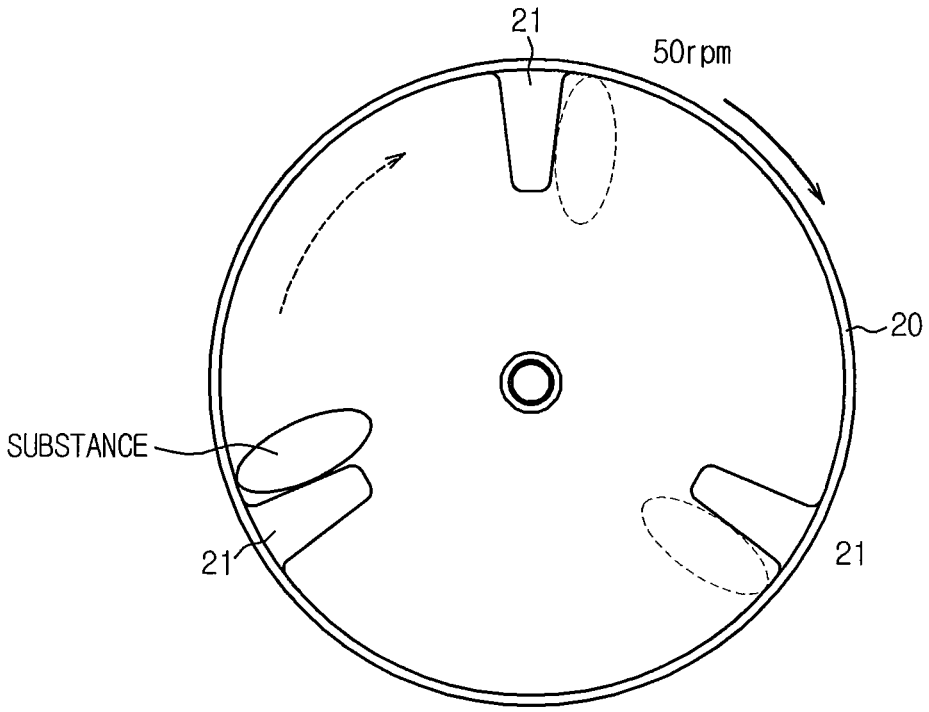

FIG. 6 is a flowchart illustrating an algorithm for controlling an operation rate in a drying operation for a small load, in accordance with the embodiment of the present disclosure. FIGS. 7A to 7C are views illustrating a state of a substance inside a dry tub of the clothing dryer having an operation rate controlled in accordance with the embodiment of the present disclosure, in a drying operation for a small load.

Referring to FIG. 6, if a user selects the second selecting unit 102 (300), the control unit 110 determines that the amount of the substance corresponds to a small load and controls the on/off of the operation rate of the dry tub 10.

In order to the control the operation rate of the dry tub 20, the control unit 110 operates the driving motor 31 at a speed of about 50 RPM to rotate the dry tube 20 in one direction as shown in FIG. 7A (302).

FIG. 7A is a view illustrating a state of a substance inside a dry tub of the clothing dryer rotated at an operation rate on-mode with a speed of 50 RPM. If the dry tub 20 is rotated at a speed of 50 RPM, the substance while being attached to the inner wall of the dry tub 20 is rotated along the dry tub 20.

In this case, the control unit 110 counts the time during which the dry tub 20 is rotated in one direction at a speed of 50 RPM, and determines whether a first time, which is preset as the ON-time of an operation rate needed for a smooth tumbling of the substance of a small load, for example, 10 seconds, is passed (304).

As a result of determination in the operation 304, if determined that the first time is not passed, the control unit 110 performs a next operation by providing a feedback to the operation 302 until the first time is passed.

Meanwhile, as a result of determination in the operation 304, if determined that the first time is passed, the control unit 110 stops rotating the dry tub 20 as shown in FIG. 7B (306).

FIG. 7B is a view illustrating a state of a substance inside a dry tub of the clothing dryer at an operation rate off-mode with a speed of ORPM. If the control unit 110 stops the dry tub 20 at an operation rate with a speed of ORPM, the substance, having been rotated while being attached to the inner wall of the dry tub 20, is stopped and remains still at the bottom of a lower end of the dry tub 20.

In this case, the control unit 110 counts the time during which the dry tub 20 remains still, and determines whether a second time, which is preset as the OFF-time of an operation rate needed for a smooth tumbling of the substance of a small load, for example, 5 seconds, is passed (308).

As a result of determination in the operation 308, if determined that the second time is not passed, the control unit 110 performs a next operation by providing a feedback to the operation 306 until the second time is passed.

Meanwhile, as a result of determination in the operation 308, if determined that the second time is passed, the control unit 110 determines whether the dryness of the substance reaches a target degree of dryness so as to end the drying cycle (310).

As a result of determination in the operation 310, if the drying cycle is determined to end, the control unit 110 ends, and if the drying cycle is determined not to end, the control unit 110 provides a feedback to the operation 302 to rotate the dry tub 20 at a speed of 50 RPM until the drying cycle is determined to end as shown in FIG. 7C.

FIG. 7C is a view illustrating a state of a substance inside the dry tub rotated at the ON-mode of an operation rate at a speed of 50 RPM again. If the dry tub 20 is rotated at a speed of 50 RPM, the substance having remained still changes a position inside the dry tub such that the substance makes contact with the inner wall of the dry tub 20 at a different surface thereof. That is, the substances is folded at a different surface thereof when compared to that shown in FIG. 7A.

As a result, as shown in FIGS. 7A to 7C, the operation rate of the dry tub 20 is alternated between ON and OFF, the shape of a surface of the substance making contact with the inner wall of the dry tub 20 keeps changing, so all the surfaces of the substance uniformly makes contact with hot air. Accordingly, the substance of a small load may be uniformly mixed and dried while being tumbled even at a dryness exceeding a predetermined degree the same manner a substance of a normal load is dried while being uniformly tumbled.

Hereinafter, (2) a scheme of setting a control temperature of the latter half of a drying operation in consideration of the rise of the internal temperature of the dry tub 20 during the drying of a small load will be described as an example of the method of changing an algorithm of a sensor-dry course.

An algorithm of a sensor-dry course designed based on a standard capacity performs a drying cycle with a drying temperature that is set to be adapted to the characteristics of the clothes material for each of the dry courses (for example, the normal-dry course, the towel-dry course, the perm-dry course, and the delicate-dry course).

However, in a case of a small load, a control temperature of the latter half of a drying operation is adjusted through the internal temperature inside the dry tub 20 detected by the temperature sensor 95 in compensation for the degradation of a performance to control a temperature. In this manner, a change is made into a control temperature to be adapted to a small load by use of the internal temperature of the dry tub 30 detected by the temperature sensor 95.

Since the second selecting unit 102 is selected, the substance contained in the dry tub 20 is primarily determined as a small load. However, the increase of internal temperature of the dry tub 20 during a drying of a small load is higher than that during a drying of a standard capacity, and the decrease of internal temperature of the dry tub 20 during a drying of a small load is lower than that during a drying of a standard capacity. In the latter half of a drying operation of a small load, the internal temperature of the dry tub 20 is measured to be higher than that of the dry tub 20 during a drying operation of a standard capacity. The rapid increase of temperature as such requires more of control operations of the heater 81, and degrades the drying efficiency.

In this regards, the control unit 110 changes a control temperature of the latter half of the drying operation of a small load to be lower than a control temperature of the standard capacity. Accordingly, the clothes material of the substances is prevented from being exposed to an excessively high temperature, and the drying efficiency is prevented from being degraded due to increase of control operations of the heater 81.

(3) The scheme of setting the drying time suitable for the characteristic of a small load through the variation of a dryness sensing value in the beginning of drying will be described as an example of the method of changing an algorithm of a sensor-dry course.

An algorithm of a sensor-dry course designed based on a standard capacity performs a drying cycle with a drying time that is set to be adapted to the characteristics of the cloth material for each of the dry courses (for example, the normal-dry course, the towel-dry course, the perm-dry course, and the delicate-dry course).

However, in a case of a small load, the drying time is calculated through a sensing value of an electric signal measured as the substance makes contact with the dryness sensor 90 in compensation for the degradation of a performance to determine dryness.

In this manner, the ending time for drying operation is set to be adapted to the type of the small load for each weight by use of the variation of an initial sensing value measured through the dryness sensor 90.

Since the second selecting unit 102 is selected, the substance contained in the dry tub 20 is primarily determined as a small load. The weight of moisture contained in the substance is different for each cloth material.

In this regards, the control unit 110 calculates a variation of a sensing value by detecting an initial sensing value measured through the dryness sensor 90 for a predetermined period of time. Since the variation of the sensing value is different with the weight of the substance, the ending time for drying operation is set to be adapted to the type of cloth material of a small load by use of the variation of the sensing value, thereby preventing the cloth material from being damaged due to an excessive drying.

For example, when assumed that the total drying time is about 40 minutes, the total drying time is divided into about 10 minutes (or about 6 minutes), about 20 minutes (or about 24 minutes), and about 10 minutes to be referred to as an initial period, an interim period, and a latter period of the drying operation, respectively. Accordingly, the weight of a small load is calculated through a sensing value of an electric signal measured as the dryness sensor 90 makes contact with the substance in the initial period. In this manner, the ending time for drying operation may be changed depending on the type of the cloth material in consideration of that the amount of moisture contained may be different with the type of cloth material.

As described above, the control unit 110 performs the drying cycle by changing an algorithm of a sensor-dry course to an algorithm capable of controlling the operation rate, the temperature (the control temperature in the latter half in the drying operation) and the degree of dryness (drying time) to be adapted to a small load. Hereinafter, the drying cycle having an algorithm changed to be adapted to a small load will be described with reference to FIG. 8.

Figure 8:
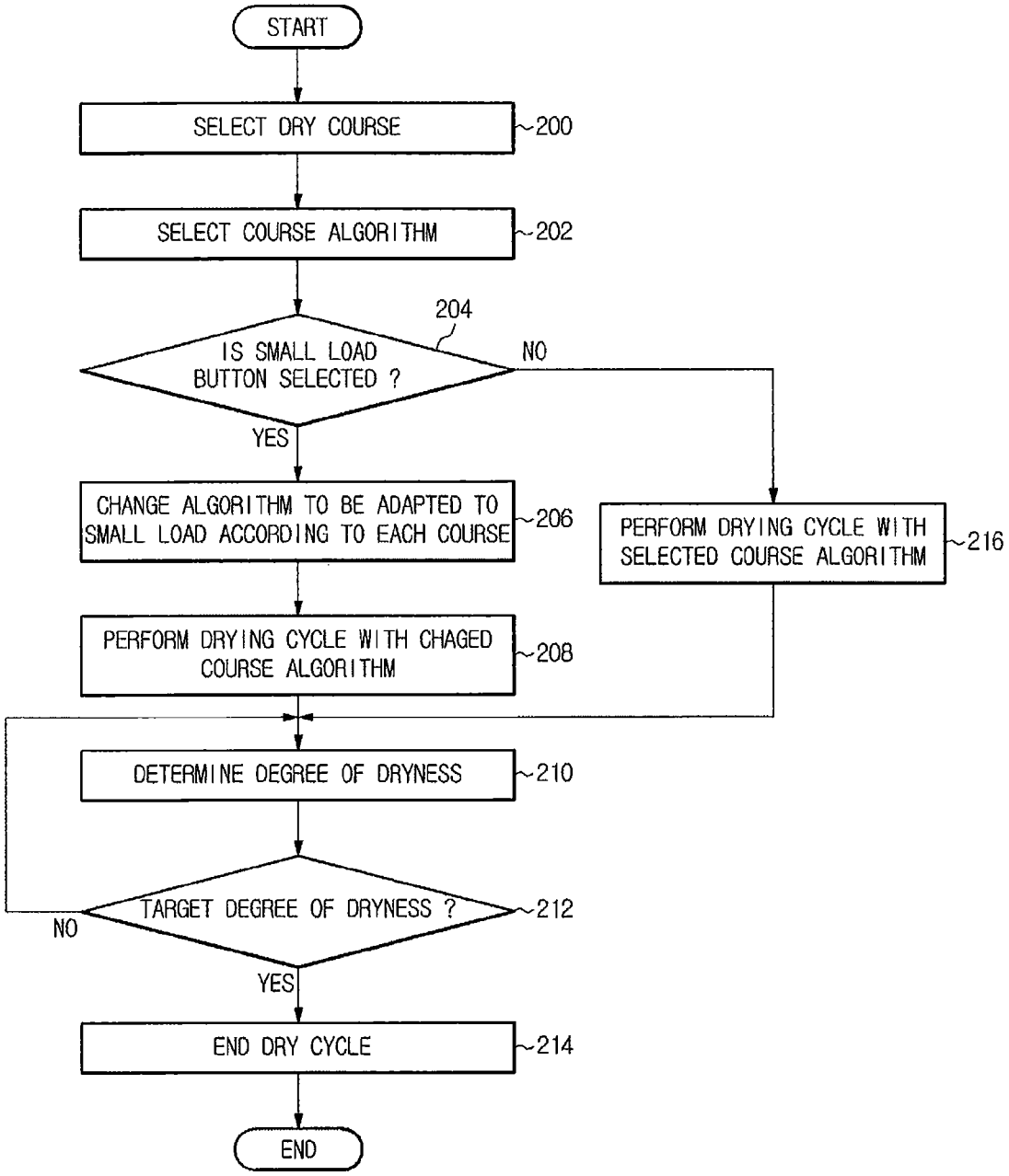
FIG. 8 is a flowchart illustrating an algorithm for controlling a drying operation for a small load, in accordance with the embodiment of the present disclosure.

FIG. 8 is a flowchart illustrating an algorithm for a drying operation for a small load, in accordance with the embodiment of the present disclosure.

In FIG. 8, a user inputs a substance to be dried into the dry tub 20, and selects a sensor-dry course (for example, the normal-dry course, the towel-dry course, the perm-dry course, or the delicate-dry course) by manipulating buttons of the input unit 100 disposed on the control panel 14 (200).

If a user selects a dry course to be adapted to the type of the substance, operation information for the selected dry course is input to the control unit 110 through the input unit 100.

Accordingly, the control unit 110 calls a course algorithm for the selected course according to the operation information of the dry course delivered through the input unit 100 (202).

In general, the course algorithm of the dry course is designed based on the standard capacity, and performs the drying cycle with a target degree of dryness, a drying temperature, a drying time, and an operation that are preset to be adapted to the type of cloth material for each dry course (for example, the normal-dry course, the towel-dry course, the perm-dry course, and the delicate-dry course). The course algorithm of the dry course may be stored in an internal memory of the control unit 110 or in an external memory connected to the control unit 110.

The user, after selecting the dry course to be adapted to the type of cloth material, determines whether the amount of the substance corresponds to a small load. In this case, the determining of the amount of the substance may be subjective and vary, but it is assumed that the amount of the substance is less than the volume of the dry tub 20 from an object point of view, as the amount of the substance corresponds to a small load.

If determined that the amount of the substance corresponds to a small load, the user selects the second selecting unit 102 provided on the input unit 100 (204).

In this case, the selecting of the second selecting unit 102 may be possible with respect to all of the dry courses such that an algorithm for a dry course is changed with the temperature and the sensing range according to the cloth material of the substance while using the target degree of temperature, the drying temperature and the drying time set to be adapted to the cloth material of the substance for each dry course (the normal-dry course, the towel-dry course, the perm-dry course, or the delicate-dry course).

If the user selects the second selecting unit 102, selection information of the second selecting unit 102 is input to the control unit 110 through the input unit 100.

Accordingly, the control unit 110 changes a course algorithm of the selected dry course according to the selection information of the second selecting unit 102 delivered through the input unit 100 into an algorithm suitable for a small load (206).

The changed course algorithm of the dry course represents an algorithm to control the operation rate, the temperature (the control temperature in the latter half of the drying operation), or the degree of dryness (drying time) to be adapted to the characteristics of the small load in compensation for the degradation of a performance to determine the degree of dryness or control a temperature in a case of a small load. The algorithm corresponds to (1) a scheme of controlling an operation rate to be adapted to a small load, (2) a scheme of setting a control temperature of the latter half of a drying operation in consideration of the rise of the internal temperature of the dry tub 20 during the drying of a small load, and (3) a scheme of setting a drying time suitable for the characteristic of a small load through the variation of a dryness sensing value in the beginning of drying, each of the scheme has been described above and the detailed description thereof will be omitted.

Thereafter, the drying cycle is performed with the changed course algorithm for the dry course (208). The drying cycle is achieved as the control unit 110 operates the driving motor 31 and the heater 81 through the driving unit 120.

In detail, according to the operation of the driving motor 31, the dry tub 20 is rotated and thus the substance inside the dry tub 20 is rotated, and the blower fan 61 is rotated according to the operation of the driving motor 31 and the air inside the clothing dryer 1 starts to move.

In this case, according to the operation of the heater 81, the air moving inside the clothing dryer 1 is heated and a heated air (hot air) is generated. The hot air generated is introduced to the inside the dry tub 20 through the hot air duct 70. The hot air introduced to the inside the dry tub 20 makes contact with the substance rotating while ascending and descending inside the dry tub 20, thereby performing a drying operation to evaporate the moisture contained in the substance to dry the substance.

According to a drying operation as such, the degree of dryness starts to be lowered. The degree of dryness detected through the contact with the substance rotating inside the dry tub 20 is determined by the dryness sensor 90, and then input to the control unit 110 (210).

Accordingly, the control unit 110 determines whether the determined degree of dryness determined by the dryness sensor reaches a target degree of dryness (212), and if determined that the degree of dryness does not reach the target degree of dryness, provides a feedback to operation 210 to perform the next operation.

As a result of operation 212, if determined that the degree of dryness reaches the target degree of dryness, the control unit 110 stops operating the driving motor 31 and the heater 81 through the driving unit 120 to end the drying cycle (214).

Meanwhile, as a result of determination in the operation 204, if determined that the user does not select the second selecting unit 102, the drying cycle is performed with a course algorithm for the dry course selected in the operation 202 (216). The course algorithm for the selected dry course performs the drying cycle based on an operation rate, a degree of drying (drying time) and a temperature (a control temperature in the latter half of the drying operation) that are independent of the amount of the substance.

Meanwhile, the embodiment of the present disclosure is made, as an example, in relation that the second selecting unit 102 is separately provided such that a user determines whether the amount of the substance corresponds to a small load from a subjective point of view, and if the second selecting unit 102 is selected, the course algorithm is changed to be adapted to the small load. The present disclosure is not limited thereto, a touch key 131 is provided on the display unit 130 to detect and display whether the amount of the substance corresponds to a small load. The method of detecting whether the amount of the substance corresponds to a small degree through the touch key 131 on the display unit 130 will be described with reference to FIG. 9.

Figure 9:
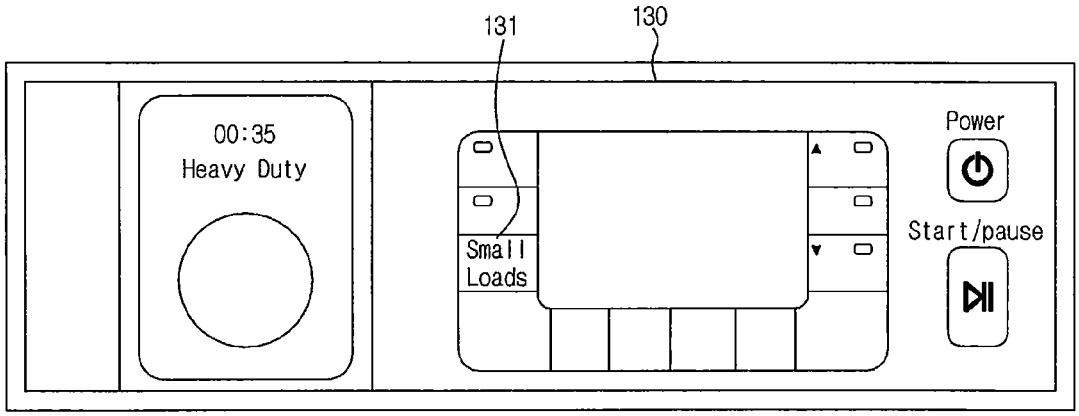
FIG. 9 is a view illustrating a screen to select a drying operation for a small load in the clothing dryer in accordance with the embodiment of the present disclosure.

FIG. 9 is a view illustrating a screen to select a drying operation for a small load in the clothing dryer in accordance with the embodiment of the present disclosure.

Referring to FIG. 9, a user inputs a substance to be dried to the inside of the dry tub 20, and selects a sensor-dry course (for example, the normal-dry course, the towel-dry course, the perm-dry course, or the delicate dry course) to be adapted to the type of the substance by manipulating the buttons of the input unit 100 disposed on the control panel 14.

If the user selects a dry course to be adapted to the type of the substance, operation information of the selected dry course is input to the control unit 110 through the input unit 100.

Accordingly, the control unit 100 calls a course algorithm of the selected dry course according to the operation information of the dry course delivered through the input unit 100, and displays a cycling process of the called dry course on the display unit 130 disposed on the control panel 14.

In this case, the touch key 131 is displayed on the display unit 130 so as to display the cycle process of the dry course while detecting the amount of the substance (the amount of laundry) input into the dry tub 20, thereby enabling a user to recognize whether the amount of the substance input to the dry tub 20 corresponds to a small load.

As the user manipulates the touch key 131 on the display unit 130, the control unit 110 recognizes touch information input by the user, and detects the amount of the substance (the amount of laundry), and if the detected amount of the substance corresponds to a small degree, the control unit 110 displays the result on the display unit 130. Accordingly, the user checks load information displayed on the display unit 130 and selects the second selecting unit 102. As the selection information of the second selecting unit 102 is input to the control unit 110, the control unit 110 performs a control such that a course algorithm is changed to be adapted to be the small load. Meanwhile, a number of methods have been suggested to detect the amount of substance (see Japanese Patent Publication No. 2002-336593, Japanese Patent Publication No. 2004-267334 and Japanese Patent Publication No. 07-90077). An example of the method of detecting the amount of substance may be achieved directly or indirectly by measuring the moment of inertia of the drum in a state that a torque is applied a motor for a predetermined period of time and using Newton's second law of motion where force equals mass times acceleration. An example of the method of detecting the amount of substance may be achieved by use of the time taken for a motor to reach a predetermined speed or a predetermined revolution per minute (RPM) using instantaneous acceleration of the driving motor 31.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A clothing dryer comprising:

a dry tub to accommodate a substance to be dried;

a first selecting unit configured to select one of a plurality of dry courses that are set, the plurality of dry courses each representing a dry course set according to a type of the substance;

a second selecting unit configured to select an amount of the substance; and a control unit configured to select a course algorithm according to the selected dry course by the first selecting unit from the plurality of dry courses, the selected course algorithm conducting a drying cycle with a drying temperature, a drying time, and an operation rate that are set to be adapted to the type of the substance, and wherein the control unit is configured to change the course algorithm according to the selected amount of the substance by the second selecting unit.

2. The clothing dryer of claim 1, wherein the second selecting unit is a small load button selected by a user as the user determines whether the amount of the substance corresponds to a small load.

3. The clothing dryer of claim 2, wherein the small load button is a manipulation button selected by a user after the user checks sensing information about the amount of the substance.

4. The clothing dryer of claim 2, wherein the control unit determines that the amount of the substance corresponds to a small load based on the selecting of the small load button, and changes the course algorithm to be adapted to the small load.

5. The clothing dryer of claim 1, wherein the changed course algorithm conducts a drying cycle while changing at least one of the drying temperature, the drying time, and the operation rate that are set to be adapted to the type of the substance.

6. The clothing dryer of claim 5, wherein the control unit conducts the changed course algorithm by controlling on/off of an operation rate of the dry tub to be adapted to the small load.

7. The clothing dryer of claim 5, further comprising a dryness sensor configured to measure a degree of dryness of the substance, wherein the control unit conducts the changed course algorithm by setting a drying time to be adapted to the small load according to a variation of a dryness sensing value measured through the dryness sensor.

8. The clothing dryer of claim 5, wherein the control unit conducts the changed course algorithm by reducing a heater control temperature configured to adjust a temperature of inside of the dry tub to be adapted to the small load.

9. A method of operating a clothing dryer to dry a substance accommodated in a dry tub, the method comprising:

inserting the substance into the dry tub;

selecting at least one of a plurality of dry courses that are set according to a type of the substance;

determining a course algorithm according to the selected dry course, the selected course algorithm conducting a drying cycle with a drying temperature, a drying time, and an operation rate that are set to be adapted to the type of the substance;

selecting load information according to an amount of the substance;

changing the selected course algorithm according to the selected load information;

drying the substance according to the changed selected course algorithm.

10. The method of claim 9, wherein the selecting of the load information determines whether a small load button configured to select whether the amount of the substance corresponds to a small load is selected.

11. The method of claim 9, wherein the changed course algorithm conducts a drying cycle while changing at least one of the drying temperature, the drying time, and the operation rate that are set to be adapted to the type of the substance.

12. The method of claim 11, wherein the changed course algorithm controls on/off of an operation rate of the dry tub to be adapted to the small load.

13. The method of claim 11, further comprising measuring a degree of dryness of the substance, wherein the changed course algorithm sets a drying time to be adapted to the small load according to a variation of a sensing value of the measured degree of dryness.

14. The method of claim 11, wherein the changed course algorithm reduces a heater control temperature configured to adjust a temperature of inside of the dry tub to be adapted to the small load.

* * * * *